US008261663B2

(12) United States Patent
Perez Cordova et al.

(10) Patent No.: US 8,261,663 B2
(45) Date of Patent: Sep. 11, 2012

(54) DETONATOR SYSTEM WITH HIGH PRECISION DELAY

(76) Inventors: Pio Francisco Perez Cordova, Lima (PE); Juan Carlos Trejo Maguina, Lima (PE)

( * ) Notice: Subject to any disclaimer, the term of this patent is extended or adjusted under 35 U.S.C. 154(b) by 4 days.

(21) Appl. No.: 12/978,020

(22) Filed: Dec. 23, 2010

(65) Prior Publication Data

US 2011/0155012 A1 Jun. 30, 2011

(30) Foreign Application Priority Data

Dec. 30, 2009 (PE) ..... 001341-2009/DIN

(51) Int. Cl.
*F23Q 21/00* (2006.01)
*F42C 9/00* (2006.01)
*F42C 11/06* (2006.01)

(52) U.S. Cl. ..... 102/215; 102/206; 102/218; 102/275.5

(58) Field of Classification Search ..... 102/200, 102/206, 207, 215, 218, 318, 275.4, 275.5, 102/275.6
See application file for complete search history.

(56) References Cited

U.S. PATENT DOCUMENTS

| | | | | |
|---|---|---|---|---|
| 5,377,592 | A * | 1/1995 | Rode et al. | 102/210 |
| 5,435,248 | A * | 7/1995 | Rode et al. | 102/210 |
| 5,912,428 | A * | 6/1999 | Patti | 102/215 |
| 5,929,368 | A * | 7/1999 | Ewick et al. | 102/215 |
| 2012/0012019 | A1 * | 1/2012 | Harding et al. | 102/206 |

* cited by examiner

*Primary Examiner* — James Bergin
(74) *Attorney, Agent, or Firm* — Sanchelima & Associates, P.A.

(57) ABSTRACT

An electrical delay detonator for use in blasting initiation systems energized by a non-electric impulse signal transmitted through a non-electrical conduit, such as a shock tube, with one end inserted inside a detonator housing having redundant sensors for detecting the presence of a non-electric impulse signal and a computerized control circuit for actuating the firing circuit. An elevated voltage is generated, stored in a capacitor assembly, and discharged when fired to an electrically operable igniter. The igniter, when activated, detonates an explosive mass. A battery is also contained within the detonator housing for powering the control circuit and one sensor, in low consumption mode, for several days. Upon detecting the presence of a signal the rest of the circuits are powered up. Periodic time windows generated by the control assembly provide corresponding enabled time periods for the sensors to become operational.

11 Claims, 8 Drawing Sheets

DETONATOR SYSTEM WITH HIGH PRECISION DELAY

BACKGROUND OF THE INVENTION

1. Field of the Invention

The present invention relates to a detonator (or blasting cap) system with high precision delay, and more particularly, to such a detonator system for mining, quarrying, and construction where the sequencing of detonation of output charges is important to achieve predetermined results.

2. Description of the Related Art

Several designs for detonator systems have been designed in the past. None of them, however, includes the detection of the different characteristics (pressure/shock, light emission, and heat) of an incoming non-electric impulse with a redundancy in order to avoid false detonations. The prior art systems utilizing non-electrical impulses only use the shock characteristic typically to activate a piezoelectric generator. The present invention detects the additional characteristics of a non-electrical impulse, such as the light emitted, its pressure, and its spark. The present invention does not depend exclusively on the generation of electricity by a transducer from the mechanical force of an incoming impulse. By providing a redundant system for accurately delaying the detonation, undesirable results are avoided that could be caused by erratic currents, magnetic fields, movements, and other mechanical effects from the area.

The shock tube is known in the art and it is made out of a plastic hose or conduit with an explosive mass in its interior. Examples of these explosive masses are PETN, hexogens, octogens, HNS, or a mixture of pyrotechnic material. The objective in the non-electrical impulse systems is to deliver the initial detonation with accurate delays and without requiring complicated electrical connections for the transmission line. To obtain the electrical energy, most systems rely on the energy transmitted through a shock tube, but this approach limits the circuitry that can be utilized as well as the length of the time it can be used without exhausting the power acquired through a piezoelectric generator. The latter limitation also affects the magnitude of the delays that can be achieved. If a battery element is included, the energy stored in the battery should be kept below a threshold amount to avoid accidental explosions, as documented in U.S. Pat. No. 5,435,248 (Rode et al), col. 4, lines 3-6. Many times it takes days from the time a system is deployed for it to be activated at a subsequent time.

Applicant believes that the closest reference corresponds to U.S. Pat. No. 5,435,248 issued to Rode et al in 1998 for an extended range digital delay detonator. However, it differs from the present invention because the extended range digital delay detonator, while using an incoming non-electrical impulse, fails to provide for the necessary redundancy to avoid accidental malfunctioning of the circuit. The present invention provides for a number of different and independent circuits that analyze the input impulse for its different characteristics. Additionally, the present invention's circuitry is not active at all times. Rather, it is active only at predetermined times periods, thus saving energy. The sensors are enabled over predetermined windows or periods of time. Also, the voltage potential is raised to levels that will trigger the detonator charge at a time just prior to the detonation, reducing the risk of accidental detonation at other times.

The disclosures in U.S. Pat. Nos. 5,435,248 and 5,377,592, to the extent that they use a capacitor only to store energy for the pertinent electronic circuits, have power limitations that can result in the failure of their systems to operate. The selection of a combination of low power batteries to permit a system to last for days while keeping it rated value below a threshold that could accidentally activate the primary explosive charge in the electric detonator is a problem in the industry. The present invention resolves this problem, and others, by selecting a battery low enough power to minimize accidental activation, management of independent circuitry that is kept in ultra low power consumption mode, and providing sampling windows to reduce the duty cycle consumption further until the detection of an input impulse in the shock tube.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a detonation system that utilizes a non-electrical incoming impulse to activate at least two independent sensors for pressure, impact, light, and heat.

It is another object of this invention to provide a system where the above-mentioned characteristics are used to produce redundant determination for precise sequential timing of explosions.

It is still another object of the present invention to provide a detonation system with redundant independent circuits that permit energy savings.

It is yet another object of this invention to provide such a detonation system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
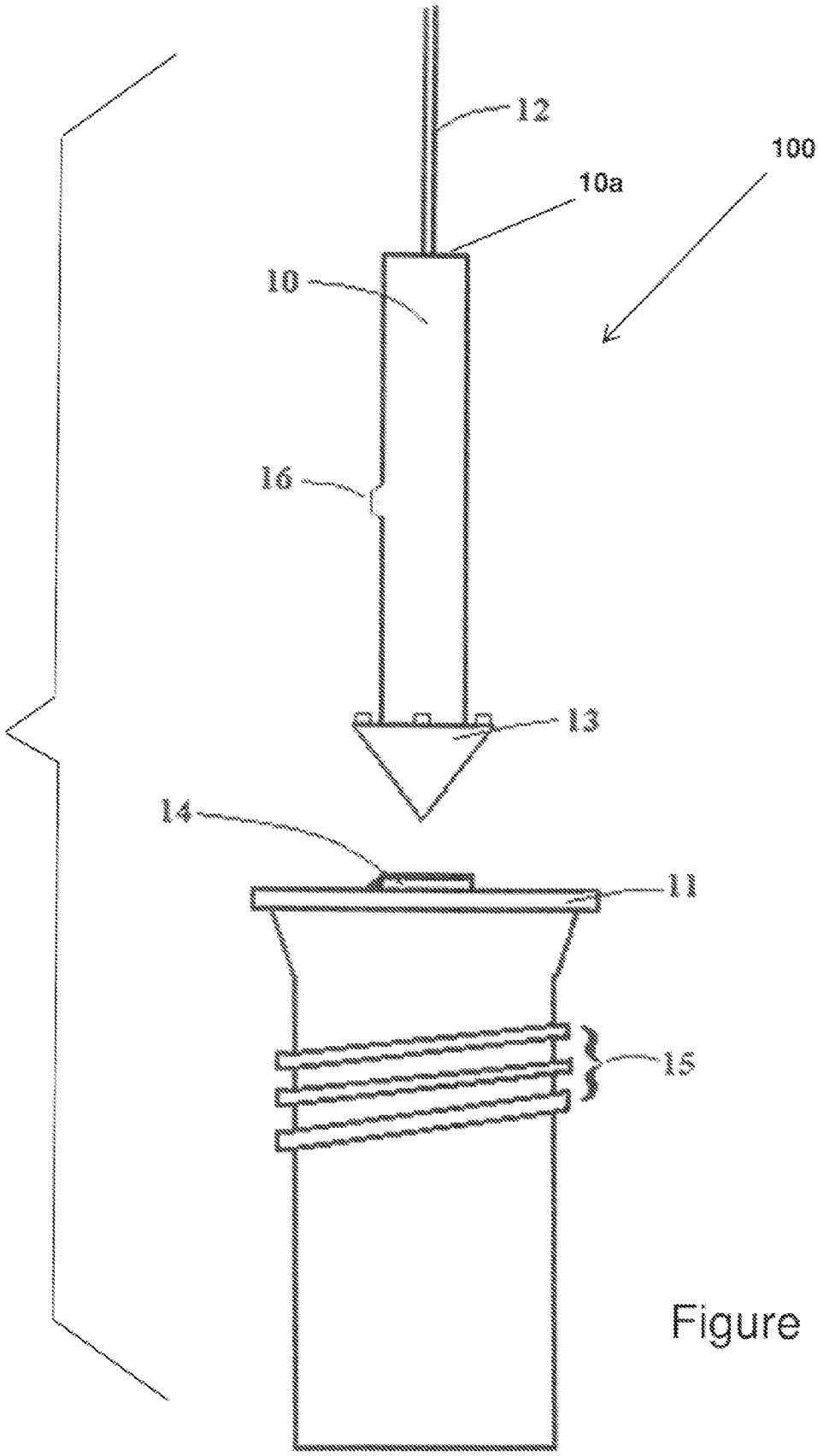
FIG. 1 represents an elevational view of shock tube 12 connected to housing 10 in position to be inserted inside the booster charge housing assembly 11.
Figure 2:
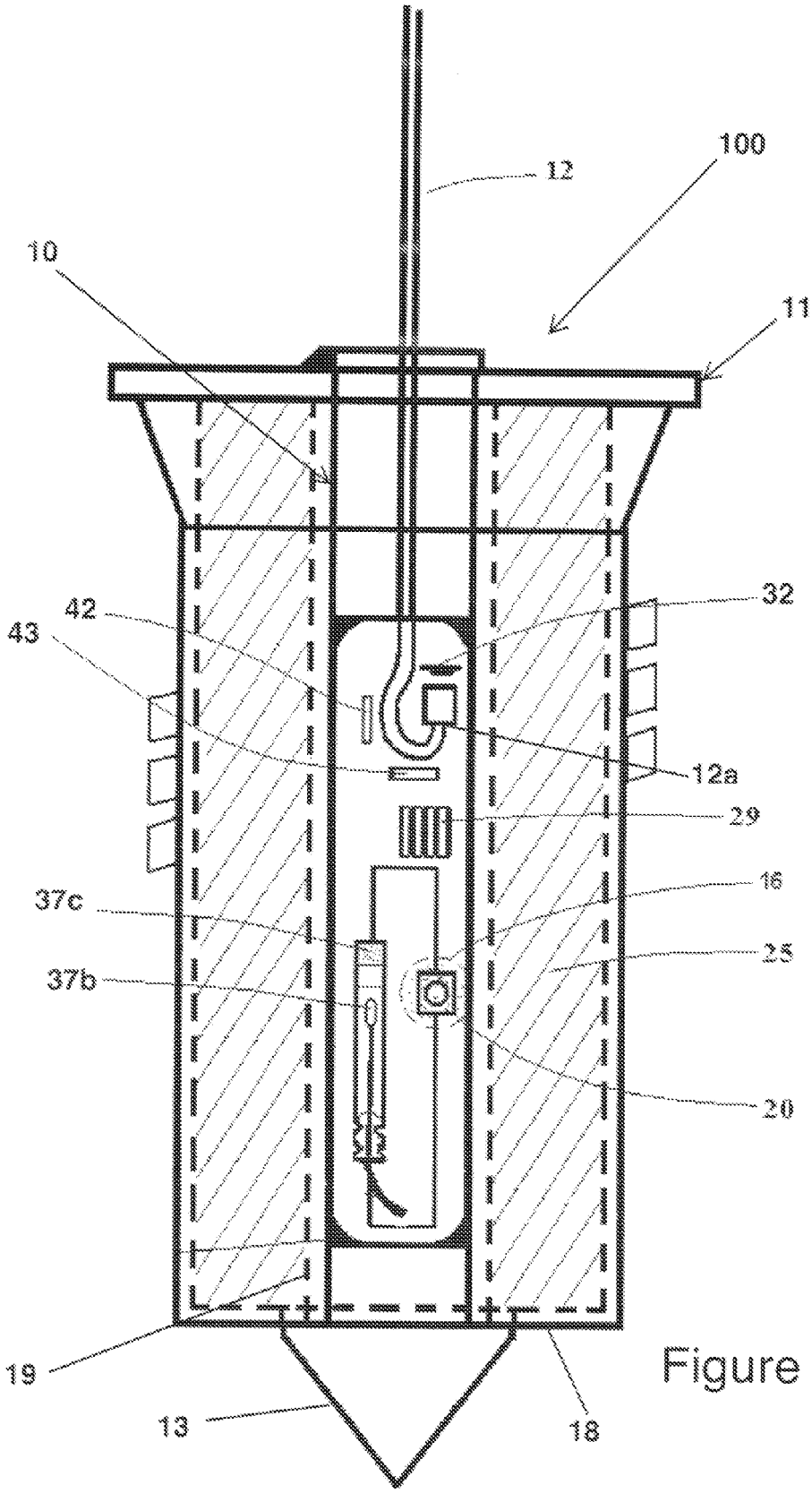
FIG. 2 shows an elevational cross-sectional view of the members shown in the previous figure with housing 10 in place.

Referring now to the drawings, where the present invention is generally referred to with numeral 100, it can be observed that it basically includes detonator container or housing 10 with an open end 10*a* through which shock tube 12 enters and main charge assembly 11 cooperatively receives therein container 10. Latch assembly 14 engages container 10. As seen in FIG. 1, container 10 includes foldable anchorage member 13, having a substantially conical shape in one of the embodiments. FIG. 1 also shows a flexible membrane 16 that is cammingly pushed in when container 10 is inserted inside assembly 11. Assembly 11 includes main explosive charges 25. Membrane 16 is intended to prevent the entry of foreign material inside container 10. This mechanical displacement actuates switch 20, as shown in FIG. 2, thereby activating some of the circuits inside the container. As seen in FIG. 2, a portion of shock tube 12 penetrates inside container 10, which in turn is completely housed within assembly 11 with anchorage member 13 protruding passed end 18 with a through central opening 19. Assembly 11 has preferably a substantially cylindrical shape with an outer thread 15 for matingly receiving cooperating annular assemblies with additional explosive charge, as needed. In use, the combined assemblies 10 and 11 are typically suspended inside a vertical bore where it is deployed.

Electric power source 29, in one of the embodiments, delivers electric power at two voltage levels: $V_1$ and $V_2$. $V_1$ is used to power the digital logic and it has a relatively low voltage (i.e. 5 volts or less). $V_2$ delivers a higher direct voltage to enable the sensors and provide the necessary energy to signal generator 35, voltage elevator 36, and firing assembly 34. In one of the embodiments, $V_2$ can vary from 6 volts to 20 volts. Solid lines represent direct connections to the battery at times after switch 20 is closed. Terminals 20*a* and 20*b* provide separate connections to voltages $V_1$ and $V_2$.

Redundant sensor assembly 31 includes two photosensors 42; 43, in one of the embodiments, for detecting the presence of the input impulse signal in shock tube 12. The interconnection of assembly 31 with the other assemblies is diagrammatically shown in FIG. 3, and in a more expanded form in FIG. 4. Redundant sensor assembly 31 sends two signals to control unit 33. The first signal comes from signal presence photosensor 42, with terminals 42*a* and 42*b* as shown in FIG. 4. Photosensor 42 is enabled when switch 20 is closed. When photosensor 42 detects the presence of the input pulse (by detecting the light emitted) it sends an electrical signal to control unit 33 and to presence circuit 46*a*. Unit 33 includes sufficient software and storage resources to initiate a counter with a pre-established count (time delay) that is accomplished in a given time period. Presence circuit 46*a* is activated. Control unit 33, in response, closes transistor switch 38 thereby activating photosensor 43. Photosensor 43 sends a signal to control unit 33 and to presence verification circuit 46*b*. Outputs from presence circuit 46*a* and presence verification circuit 46*b* are connected to the gates of transistors 39*a* and 39*b*, respectively. Switching transistor 39*a* is connected in series with switching transistor 39*b* and when both transistors are turned on, capacitor assembly 30 is connected to the ground permitting the latter to be charged up by voltage elevator 36. Switching transistors 39*a* and 39*b* can be implemented with N-channel MOSFET (metal oxide silicon field effect transistors) with minimum power consumption. The second signal comes from verified signal presence photosensor 43, with terminals 43*a* and 43*b* as shown in FIG. 4. Like with photosensor 42, photosensor 43 transmits a verification signal to control unit 33 and to presence verification circuit 46*b*. Circuit 46*b* in turn transmits a suitable signal to the gate of transistor 39*b*.

When an impulse is transmitted through shock tube 12, it reaches end 12*a* where several sensors are cooperatively disposed to detect the characteristics of the inputs with redundancy. Redundant sensor assembly 31, as explained above, utilizes photoelectric sensors. However, it is possible to use thermal sensors instead. These sensors include photoelectric, thermal, and piezoelectric elements. Sensor assembly 32 is an impact sensor connected to the end of shock tube 12. An impact sensor is implemented with a piezoelectric element 52 that generates electrical energy upon detection of the expanding wave inside shock tube 12.

The first signal generated by sensor assembly 31, coming from photosensor 42, wakes up the microprocessor included in control circuit 33, which was active at a low power mode. The time charts included as FIG. 3A show the different times of operation for the different circuits.

Figure 3:
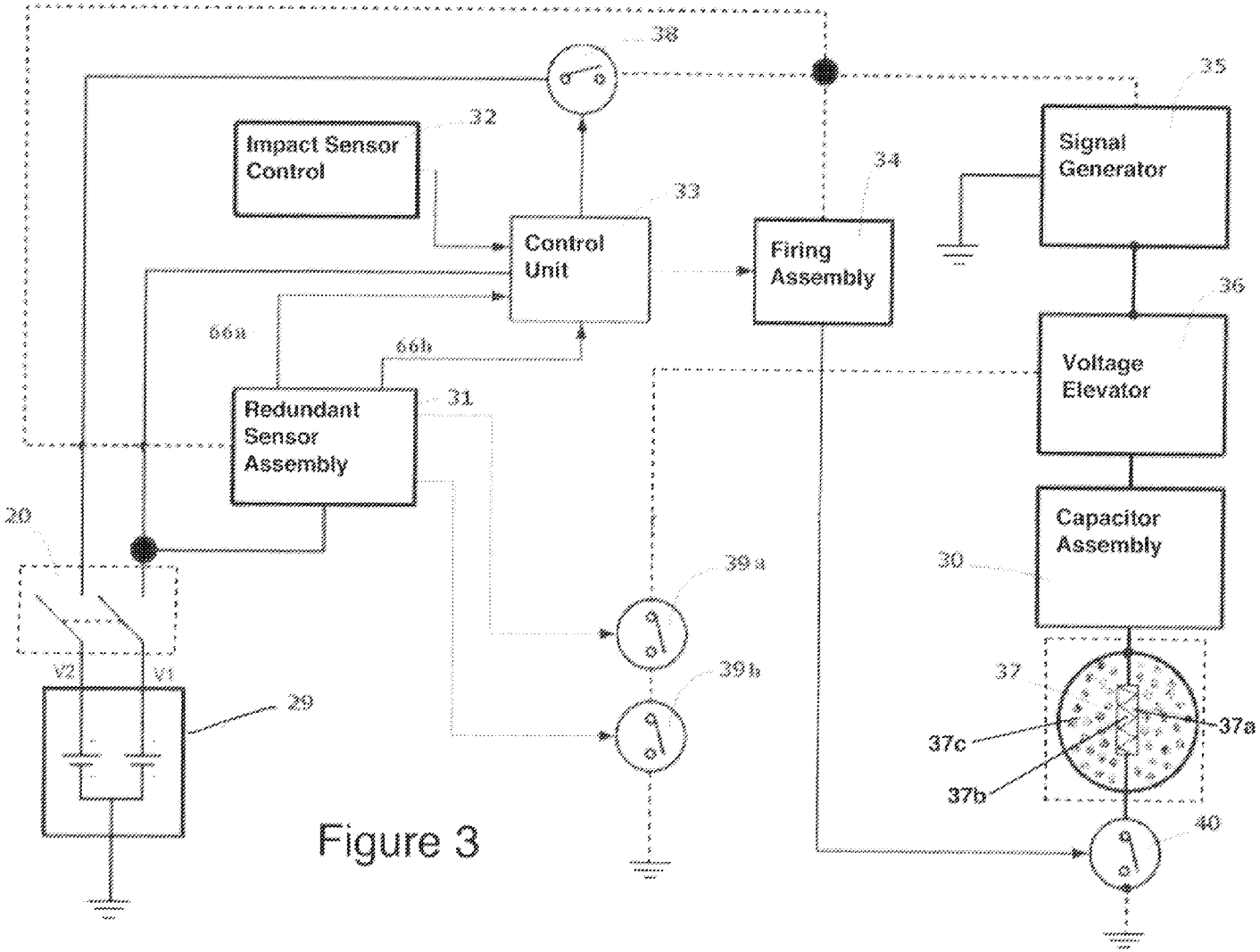
FIG. 3 is a block diagram showing the different modules used in one of the embodiments.
Figure 4:
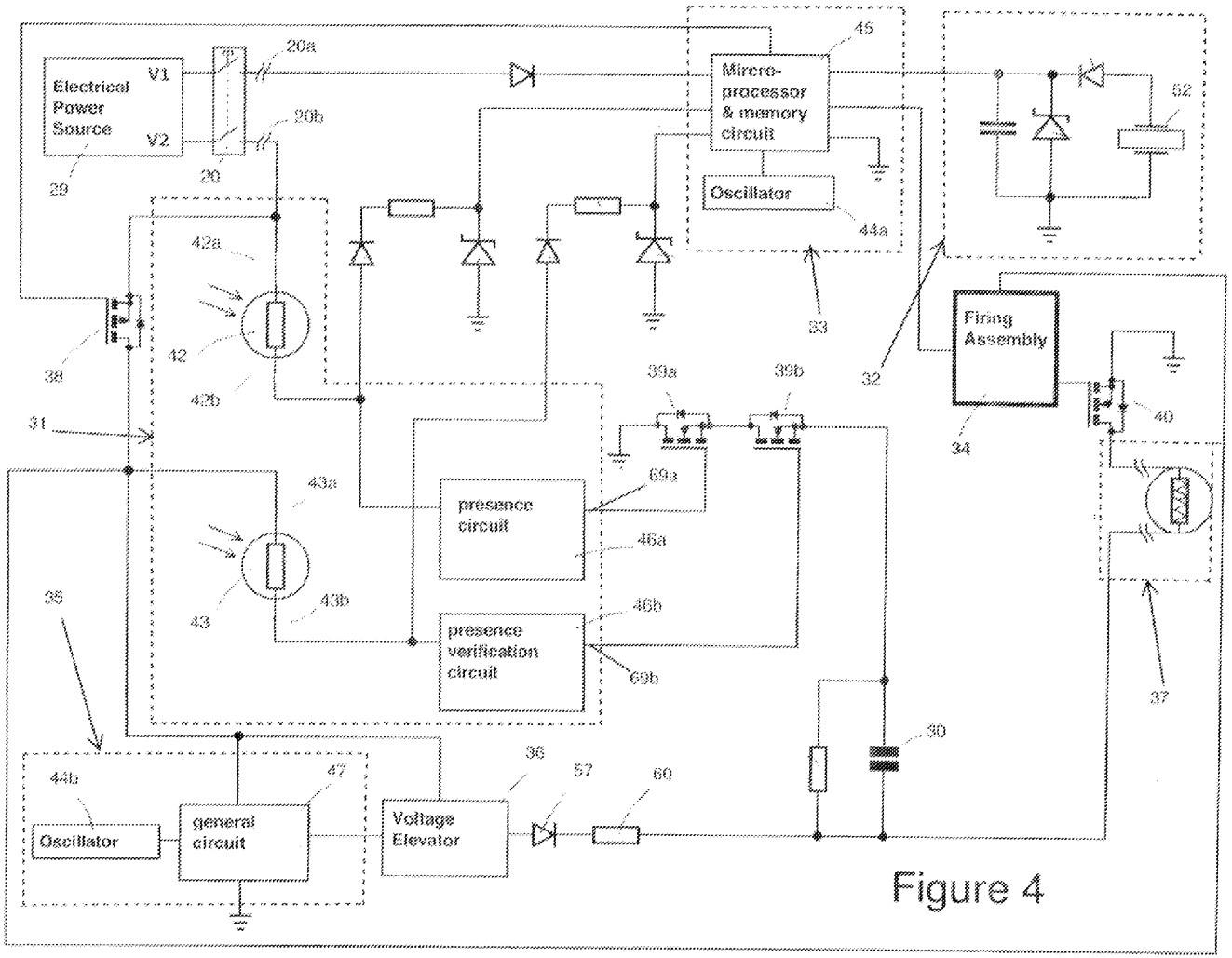
FIG. 4 is a block diagram with some discrete components used in one of the embodiments.
Figure 5:
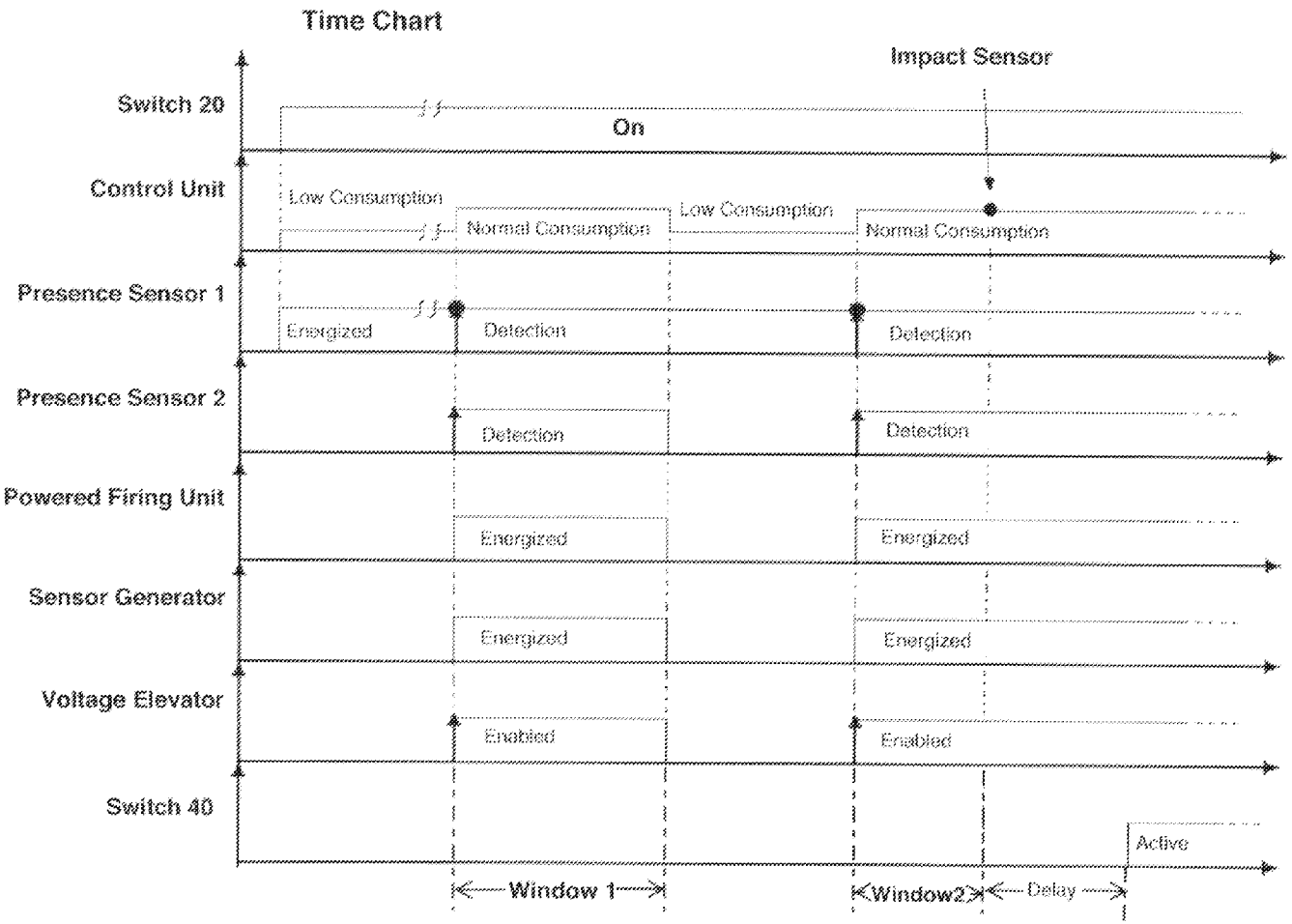
FIG. 5 is a time chart showing the existence of relevant signals or voltages at different times.
Figure 6:
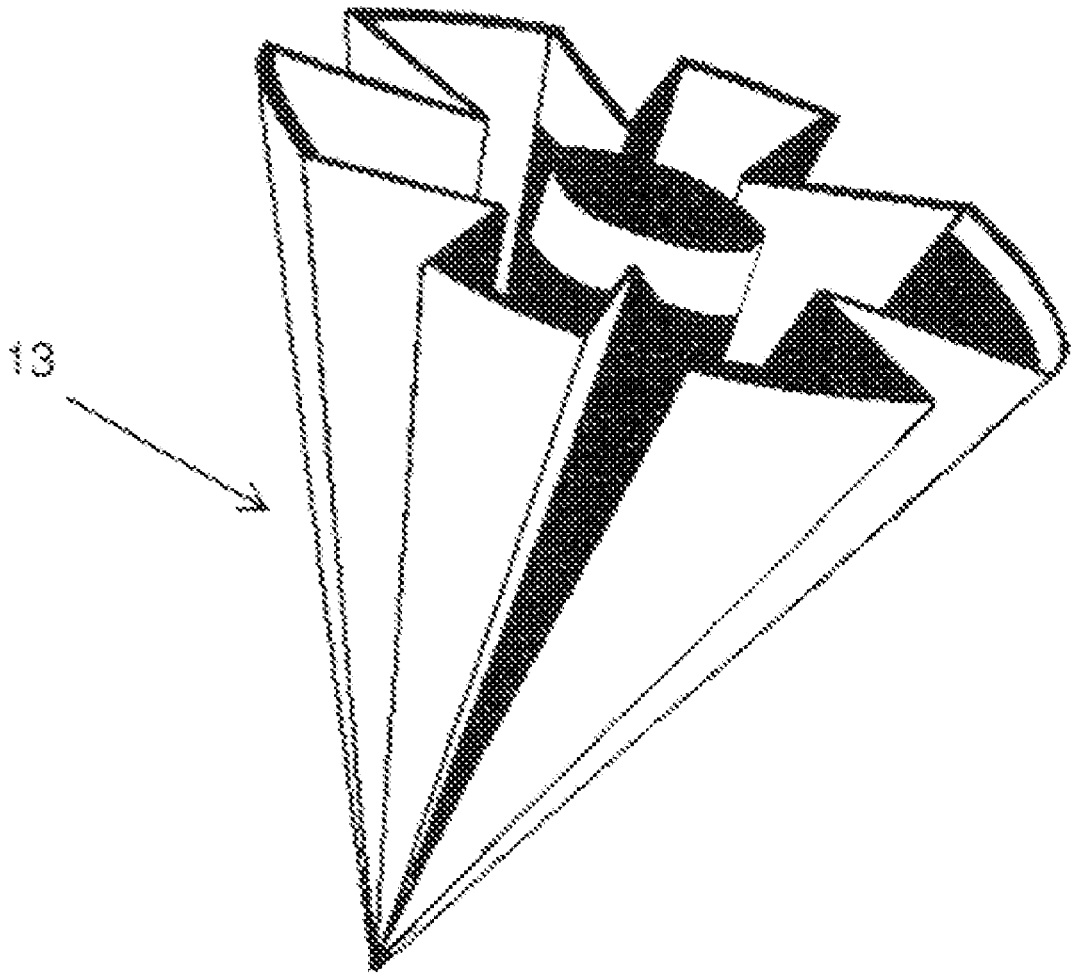
FIG. 6 is an isometric representation of expandable anchorage member 13 used to support assembly 11 in suspension.

As shown in FIGS. 3 and 4, signal generator 35 is connected to voltage elevator 36. Signal generator 35, as seen in FIG. 4, includes oscillator 44*b* and signal generator circuit 47 to provide a cooperating waveform. The resulting signal delivered to voltage elevator 36, in one of the embodiments, has a frequency that ranges from 500 Hz. to 3000 Hz. with the amplitude of voltage $V_2$ (from 6 volts to 20 volts, preferably). Voltage elevator 36 is implemented with a capacitor-based charge pump circuit, which is conventionally used to raise a direct current voltage. The duty cycle for the signal delivered by signal generator assembly 35 ranges from 40% to 60%, in one of the embodiments. The output from voltage elevator 36 is connected to charging capacitor assembly 30 through diode 57 and current limiting resistor 60.

Control assembly or unit 33 administers the different functions of the system including activating transistor switch 38 for the delivery of electrical power to the power ports of firing assembly 34, signal generator 35 and voltage elevator 36. Control unit 33 is implemented in one of the embodiments with microprocessor and memory circuit 45 with sufficient software resources. Additionally, control unit 33 provides signal windows ranging from 0.01 to 10 milliseconds, in one of the embodiments, with its internal oscillator 44*a*. These window-enabling signals are supplied to redundant sensor assembly 31 and impact sensor assembly 32. Sensor assemblies 31 and 32 are activated during those window periods only. Any other signals outside the windows are ignored. In FIG. 3A, it can be observed that the output of photoelectric sensor 42 is identified as presence sensor 1 in the chart and the output of photoelectric sensor 43 is identified as presence sensor 2. FIG. 3A shows sensors 42 and 43 detecting luminous signals that produce outputs for both sensors during window 1. However, since there is no output from impact sensor 32 during window 1, the outputs from sensors 42 and 43 are disregarded. During window 2, the outputs of sensors 42 and 43 show the existence of a luminous event at the end of shock tube 12. Since an output is detected from impact sensor 32, all three conditions are met, namely, the luminous event detected by sensor 42 with its redundant confirmation by sensor 43 and the existence of a mechanical wave pressure that activates impact sensor 32 to produce an output. In this way, a constant connection susceptible to erratic currents is avoided.

Redundant sensor assembly 31 includes outputs 69*a* and 69*b* connected to elevator enabling switching transistors 39*a* and 39*b*, respectively. Switching transistors 39*a* and 39*b* are connected in series thereby requiring the concurrent occurrence of both suitable outputs for both switches to close thereby connecting capacitor assembly 30 to ground to charge it. Switching transistors 39*a* and 39*b* are implemented with low power transistors, such as MOSFETS. In this application, the interrupted or broken lines are to be interpreted as connections that are activated and/or enabled after the activation (closing) of transistor switch 38. Assembly 31 also sends an impulse detection signal to control unit 33, which is also independently reconfirmed by another confirmation signal 66*b* generated when a second photoelectric sensor redundantly confirms the presence of the impulse.

Upon the occurrence of signals 66*a* and 66*b* from assembly 31, control unit 33 sends a signal to firing assembly 34, which in turn activates firing switch 40. Switch 40 (a transistor in the embodiment) connects capacitor assembly 30 with electrically operable igniter 37. Igniter 37 can be implemented with an incandescent resistance bridge, or equivalent device.

Electrically operable igniter 37 is implemented in one of the embodiments with an incandescent resistance bridge 37*a*, having a cooperating impregnated pyrotechnic charge 37*b* that activates primary charge 37*c*. This type of detonation sequence is known and commonly used by those learned in the art of electrically operable igniters.

Figure 7:
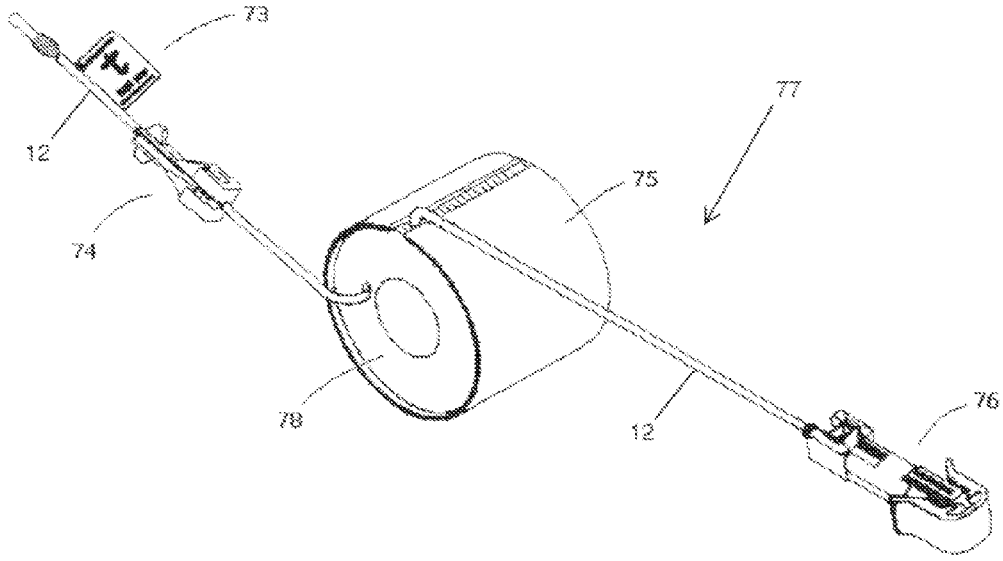
FIG. 7 shows a reel 75 connected to shock tube 12 through connection 74. Label 73 indicates the characteristics of transmission line 77.
Figure 8:
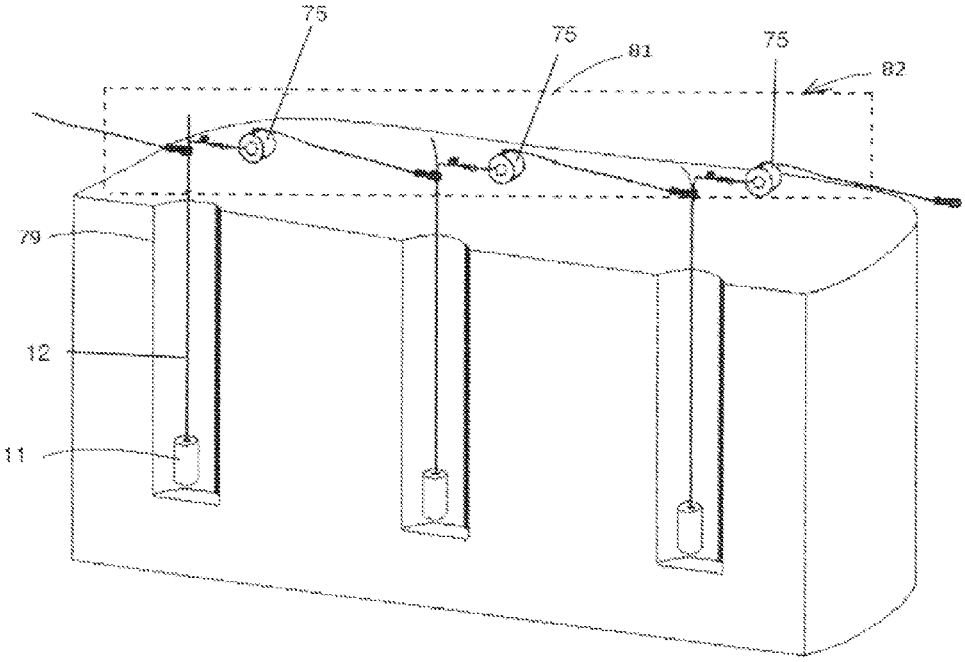
FIG. 8 is a typical sequential connection 81 of three reels with three assemblies 11 suspended inside bores 79.
Figure 9:
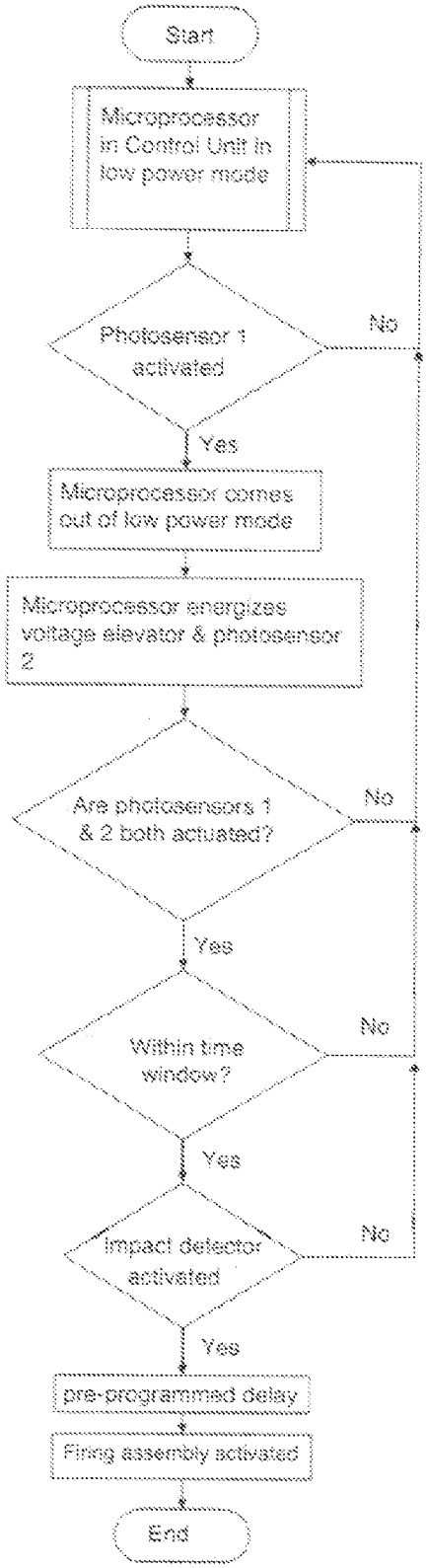
FIG. 9 is a flowchart illustrating the main steps of the activation of the electronic circuitry of one of the embodiments of the present invention.

In FIGS. 7 and 8, a typical transmission line 77 utilizing shock tube 12 connecting reels 75 through connections 76 is shown. Three sequentially connected reels 75 are indicated with numeral 82. Assemblies 11 are suspended inside bores 79 using shock tubes 12. The timing of the explosions is delayed to take into account their relative locations. A general sequence of the generation of the main signals is shown in the flowchart represented as FIG. 9. The sequence starts by switching on switch 20, placing microprocessor 45 in control unit 33 in low power mode with partial operability and just sufficient to be activated to full operability when photosensor 1 is activated. Then microprocessor 45 enables the activation of voltage elevator 36 and redundant photosensor 2. When the signal of photosensors 1 and 2 coincide within a time window, detection of an impact signal will cause microprocessor 45 to generate a pre-programmed delay to eventually activate firing assembly 34. At this point, capacitor 30 is discharged, causing pyrotechnic charge 37*b* to be activated with the rest of the charges, as this last step is conventionally done.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electrical delay detonator for use in blasting initiation systems energized by a non-electric impulse signal transmitted through a non-electrical conduit of a transmission line comprising:

A) a detonator housing having one end thereof dimensioned and configured to be coupled to an input transmission line capable of transmitting a non-electric impulse input signal to within said housing, said input signal having luminous, mechanical, and thermal characteristics;

B) battery means for supplying electric energy having power output means for delivering cooperating voltage levels and further including one negative terminal connected to ground;

C) first sensor means for detecting the presence of one of said three characteristics of said input signal and producing first and second presence signals dependent on said input signal, said first sensor means having first and second sensor members with corresponding first and second outputs for said first and second presence signals, respectively, and said second presence signal being a redundant signal for the detection of said input signal;

D) second sensor means for detecting the presence of another of said three characteristics of said input signal and producing a third presence signal dependent on said input signal and said second sensor means having a third output for said third presence signal;

E) a microprocessor based control assembly having cooperative inputs connected to said first and second sensor means, said control assembly further including software and storage resources with sufficient data and instructions to process said first, second, and third presence signals received by said control assembly within pre-programmed time windows and provide a plurality of control outputs including at least one computed programmable delay output;

F) power activating first switch means for selectively connecting said power output means to said control assembly and to the first sensor member of said first sensor means to energize them;

G) an electronic firing assembly having a firing input connected to at least one of said plurality of control outputs, and further including a firing output that is enabled when said first, second, and third signals are received during one of said time windows and a predetermined signal is present at said firing input connected to one of said at least one computed delay output;

H) a signal generator having a generator power port and a generated signal output and further including an oscillator;

I) a voltage elevator assembly having an elevator input connected to said generated signal output and further including an elevator power port and an elevator output;

J) power activating second switch means for selectively connecting said output means to said second sensor member, signal generator assembly, firing assembly, and voltage elevator assembly to energize them, said second switch means being actuated by said control assembly after the activation of said first sensor member;

K) capacitor means for storing electrical energy having a first terminal that is connected to said common and a second terminal that is connected to said elevator output;

L) first and second switch means for enabling capacitor means' first terminal connection to said elevator output when predetermined signals are received from said first and second sensor members, and said first and second switch means being connected in series;

M) electrically operable igniter means for generating sufficient explosive energy to detonate a main explosive charge, said igniting means being connected to said capacitor means to utilize the energy stored therein upon the enablement of said firing output;

N) third switch means for selectively closing the normally open connection in series of said capacitor means and said igniting means, said third switch means being activated by the firing output; and O) an explosive charge container with cooperative dimensions to receive said detonator housing and being mechanically coupled with said activating switch to activate the latter upon the introduction of said detonator housing within said container and said container further including a compartment containing a main explosive charge.

2. The electrical delay detonator set forth in claim 1 wherein said first and second sensor members of said first sensor means includes photoelectric sensors for detecting the presence of luminous characteristics of the non-electrical impulse signal.

3. The electrical delay detonator set forth in claim 2 wherein said second sensor means includes a piezoelectric sensor assembly for detecting the presence of the mechanical characteristics of the non-electrical impulse signal.

4. The electrical delay detonator set forth in claim 3 wherein said control assembly generates programmable periodic time windows for enabling and disabling the outputs from said first and second sensor means to said control assembly.

5. The electrical delay detonator set forth in claim 4 wherein the periodic time windows range from 0.01 milliseconds to 10 milliseconds.

6. The electrical delay detonator set forth in claim 5 wherein the frequency of the signal generated by said signal generator assembly ranges from 500 Hz. to 3000 Hz.

7. The electrical delay detonator in claim 1 where said first sensor means includes thermal sensors for detecting the thermal characteristics of the input signal.

8. The electrical delay detonator set forth in claim 7 wherein said second sensor means includes a piezoelectric sensor assembly for detecting the presence of the non-electrical impulse signal.

9. The electrical delay detonator set forth in claim 8 wherein said control assembly generates periodic time windows for enabling the outputs from said first and second sensor means to said control assembly.

10. The electrical delay detonator set forth in claim 9 wherein the periodic time windows range from 0.01 milliseconds to 10 milliseconds.

11. The electrical delay detonator set forth in claim 10 wherein the frequency of the signal generated by said signal generator assembly ranges from 500 Hz. to 3000 Hz.

* * * * *